United States Patent [19]

Wilson

[11] Patent Number: 4,700,152

[45] Date of Patent: Oct. 13, 1987

[54] NON-CONTACTING SIGNAL COUPLING DEVICE

[75] Inventor: Robert M. Wilson, Mercer County, N.J.

[73] Assignee: RCA Corporation, Princeton, N.J.

[21] Appl. No.: 759,833

[22] Filed: Jul. 29, 1985

[51] Int. Cl.[4] ..... H01P 5/02

[52] U.S. Cl. ..... 333/24 C; 333/115; 333/5; 333/124

[58] Field of Search ..... 333/24 C, 24 R, 261, 333/260, 257, 111, 112, 115, 124, 4, 5

[56] References Cited

U.S. PATENT DOCUMENTS

| | | | |
|---|---|---|---|
| 2,368,693 | 2/1945 | Watts, Jr. | 333/24 R X |
| 2,534,437 | 12/1950 | Ginzton | 333/24 R |
| 2,913,679 | 11/1959 | Seifert | 333/24 C |
| 2,972,121 | 2/1961 | Firestone | 333/115 |
| 3,167,727 | 1/1965 | Lunden et al. | 333/24 C |
| 3,249,854 | 3/1966 | Nevius | 333/24 R X |
| 4,054,850 | 10/1977 | Gerrish | 333/24 R |

FOREIGN PATENT DOCUMENTS

| | | | |
|---|---|---|---|
| 0074202 | 6/1980 | Japan | 333/111 |

*Primary Examiner*—Eugene R. LaRoche
*Assistant Examiner*—Benny T. Lee
*Attorney, Agent, or Firm*—Eugene M. Whitacre; Paul J. Rasmussen; Peter M. Emanuel

[57] ABSTRACT

A non-contacting type of high frequency signal coupling arrangement for coupling RF signals to a television receiver at one or more workstations for alignment or test includes a first transmission line mounted a the workstation and coupled to the RF signal source and a second transmission line mounted on the pallate for moving the television receiver from one workstation to another and coupled to the antenna input of the television receiver. At a workstation, the two transmission lines are brought into overlying relationship so that the RF signals are capacitively coupled from the first transmission line to the second.

16 Claims, 8 Drawing Figures

NON-CONTACTING SIGNAL COUPLING DEVICE

FIELD OF THE INVENTION

The present invention concerns a non-contacting signal coupling arrangement suitable for coupling high frequency signals to an instrument such as a television receiver at various workstations of an automatic assembly and/or test line.

BACKGROUND OF THE INVENTION

At various alignment and/or test workstations along a television assembly line, it is required to couple RF television signals to the RF input terminals of a television receiver undergoing manufacture. In the past, it has been common practice for a human operator at a workstation to manually connect a coaxial cable of an RF signal distribution network to the RF input terminals of the receiver. In order to reduce manufacturing costs, it is desirable to perform the operation of coupling RF signals to a receiver at various workstations automatically rather than manually.

While it is possible to design apparatus which automatically makes direct physical contact between a coaxial cable providing the RF signal and the RF input of the receiver at each workstation, such contacting type of RF signal coupling arrangements have practical limitations. For low frequency applications, rugged types of contacts, e.g., such as brushes, which are not particularly susceptible to wear, can be used. However, for high frequency signals, the contacts should be designed to have a shape that will ensure that the RF transmission system maintains its proper impedance characteristics. Such high frequency contacts are susceptible to wear, making them prone to frequent repair or replacement to ensure reliable RF signal coupling. Robotic apparatus may be used in place of a human operator at each workstation to ensure reliable contact, however such robotic apparatus is relatively expensive.

Accordingly, it is desirable to provide a non-contacting type of high frequency signal coupling arrangement which does not have the aforementioned problems of the contacting type of signal coupling arrangements but which does provide a signal to the television receiver at a workstation which is of sufficient amplitude to properly perform the required alignments and/or tests.

SUMMARY OF THE INVENTION

In accordance with the invention, non-contact signal coupling apparatus for coupling a high frequency signal to an instrument such as a television receiver at a workstation along an assembly and/or test line, includes a first pair of conductors forming a first transmission line located at the workstation and coupled, e.g., through a coaxial cable, to a source of RF signals, and a second pair of conductors forming a second transmission line coupled to and moveable with the instrument on a pallate or other conveyor to the workstation. When the conveyor reaches the workstation, the conductors of the second transmission line are guided into a parallel and overlaying relationship with respective conductors of the first transmission line to allow the RF signal from the first transmission line to be coupled to the second transmission line and thereby to the instrument.

The advantage of a high frequency coupling arrangement constructed in accordance with the invention and various embodiments will be described with reference to the accompanying Drawing.

BRIEF DESCRIPTION OF THE DRAWING

In the Drawing, the same reference number used in various FIGS. refers to the same element.

DETAILED DESCRIPTION OF THE DRAWING

Figure 1:
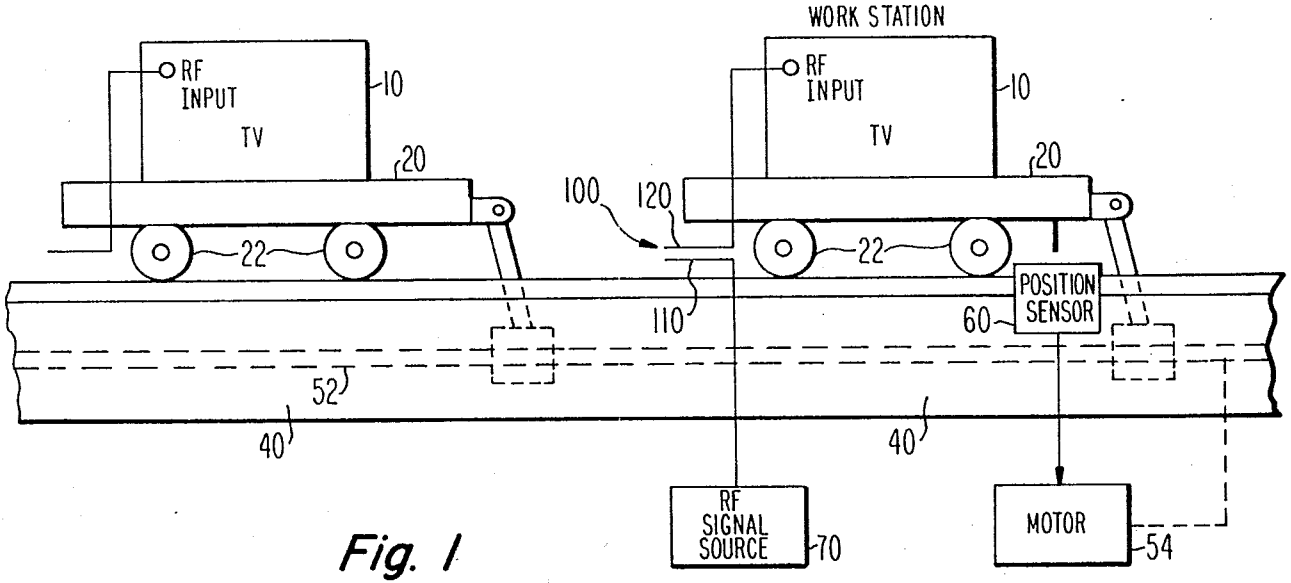
FIG. 1 shows an assembly line for television receivers indicating how a non-contact signal coupling arrangement constructed according to the invention may be employed.

In FIG. 1, a television receiver 10 is mounted on a pallate 20 equipped with rollers or wheels 22 which engage a track 30 supported by a support member 40 for moving television receiver 10 from one workstation of an assembly line to another. At each workstation various assembly, electrical alignment and/or testing operations are performed. Pallate 20 is moved from one workstation to another by a conveyor system which, as shown, by way of example, may include a drive screw or chain 52 mechanically linked to a drive motor 54. A position sensor 60 determines when pallate 20 reaches a particular point of a workstation and stops the movement of pallate 20 so that the respective operation or operations can be performed. By way of example, position sensor 60 may comprise a micro-switch triggered by an element mounted on pallate 20.

The alignment and testing of the tuner of IF sections of television 10 are among the operations performed at one or more workstations. For this purpose RF television signals correpsonding to a particular channel or group of channels from an RF signal source 70 must be coupled to an RF input, usually the antenna input, of receiver 10 at one or more workstations. Other signals, such as AC line voltage to develop supply voltages, also need to be coupled to television receiver 10. For AC line voltage and other relatively low frequency signals, a contacting type signal coupling arrangement (not shown) using rugged contacts, e.g., such as brushes which are not particularly susceptible to wear and which, therefore, provide reliable signal coupling, can be used. However, for RF and other high frequency signals, the shape of contacts should be carefully designed to provide the characteristic impedance of the transmission line coupled between the RF signal source and the contacts in order to minimize signal reflections. This special requirement of RF signal coupling arrangements makes it difficult to design contacts that are not susceptible to wear and that, therefore, do not require frequency replacement or repair. While robotic equipment could be used to perform the manual connection operation normally performed by human operators, such equipment is expensive.

The present invention concerns a high frequency signal coupling arrangement including a non-contacting type of signal coupling element which may advantageously be used in the assembly line arrangement of FIG. 1, as is schematically indicated by element 100, to couple RF television signals provided by RF signal source 70 to the RF input of television receiver 10 when receiver 10 arrives at an alignment and/or test workstation. As is shown is greater detail in FIGS. 2, 3, 4, 5, 6*a*, 6*b* and 7, basically, non-contact signal coupling element 100 comprises a pair of conductors forming a first transmission line 110 and a second pair of conductors forming a second transmission line 120. RF signal source 70 is coupled to transmission line 110 and transmission line 120 is coupled to television receiver 10. At a workstation, the conductors comprising transmission line 120 are brought into overlying relationship with the conductors of transmission line 110 with the planes defined by the respective pairs of conductors being parallel and relatively closely spaced so that the conductors of transmission line 120 are within the electric field between the conductors of transmission line 110 whereby the RF signals are capacitively coupled from transmission line 110 to transmission line 120.

The coupling between pairs of conductors comprising transmission lines 110 and 120 is superior to the coupling between single conductors for the following reasons. When transmission lines are used, the fields are contained between the two conductors and, therefore, there is very little radiation produced. Furthermore, the coupling between transmission lines has a relatively large bandwidth compared to the coupling between single conductors. The relatively large bandwidth is particularly important with respect to the coupling of RF television signals since RF television signals have a frequency range which extends approximately between 50 and 900 MHz.

Figure 6A:
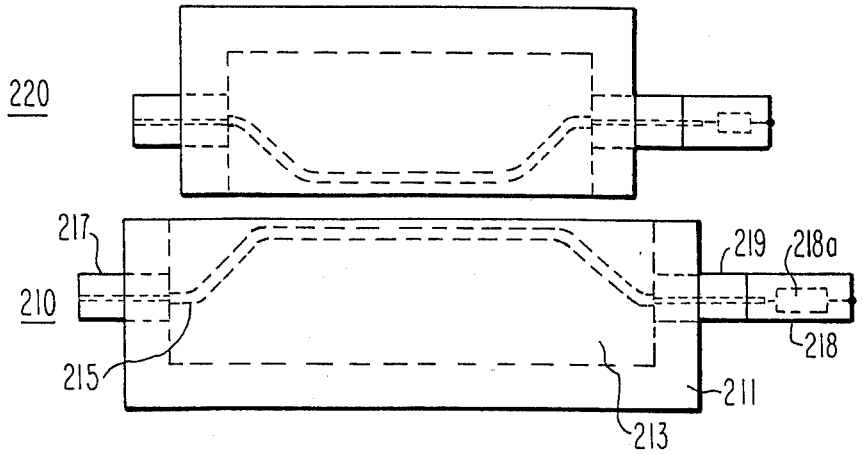
FIGS. 6*a* and 6*b* and 7 show, in detail, respective configurations of portions of other non-contacting signal coupling elements themselves, constructed according to other aspects of the invention, which may be employed in the assembly line shown in FIG. 1 in place of the non-contacting signal coupling element shown in FIGS. 2, 3, 4 and 5.
Figure 6B:
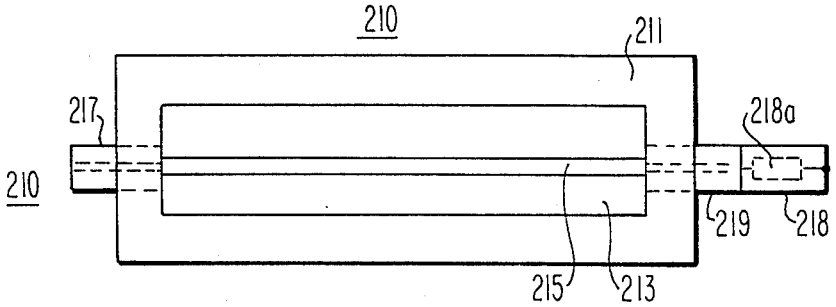
Figure 7:
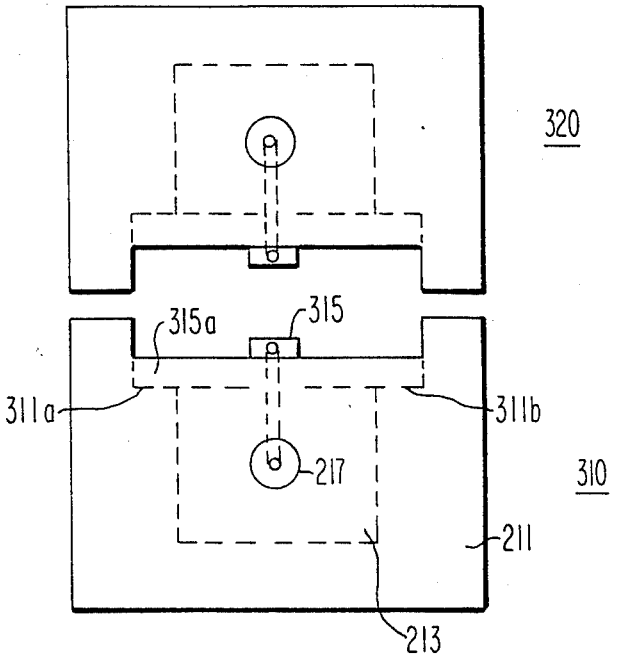

In FIGS. 2, 3, 4 and 5, transmission lines 110 and 120 are balanced transmission lines comprising respective pairs of parallel conductors. In FIGS. 6*a* and 6*b* and 7, transmission lines 110 and 120 are unbalanced transmission lines comprising two conductors arranged in a coaxial configuration.

Figure 2:
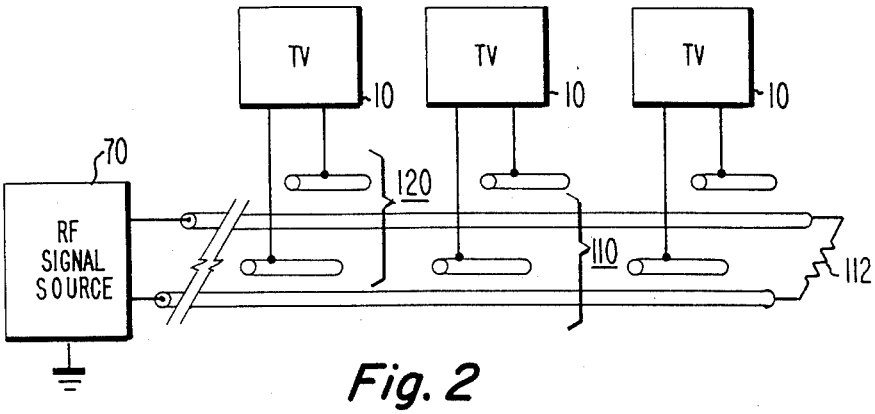
FIGS. 2 and 3 show respective electrical configurations of RF signal distribution networks employing non-contact signal coupling elements, constructed according to aspects of the invention, which may be used in the assembly line shown in FIG. 1.

In the embodiment of FIG. 2, first transmission 110 of each workstation is actually a segment of a long, continuous, balanced transmission line comprising two parallel conductors running between workstations. The long transmission line is terminated in its characteristic impedance by a resistor 112 to prevent signal reflections. The conductors of second transmission line 120 are spaced apart by the same distance as the conductors as first transmission line 110 and are supported and guided by pallate 20 shown in FIG. 1 (not shown in FIG. 2). The embodiment shown in FIG. 2 is a convenient way of distributing the RF signal to a number of workstations located along a relatively straight portion of the assembly line and allows the RF signals to be continuously coupled to a television receiver for testing as it moves along the assembly line.

Figure 3:
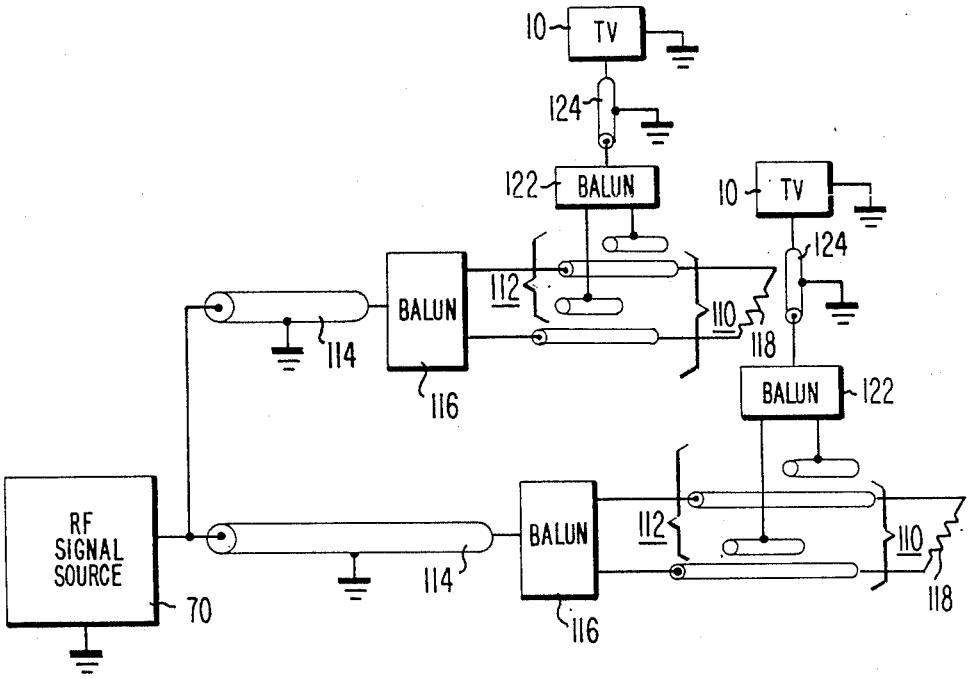

In the embodiment shown in FIG. 3, each workstation includes a respective first transmission line 110 physically separated from the others. Each first transmission line 110 is electrically coupled to RF signal source 70 by a respective coaxial cable 114 and a balun (balance-to unbalanced) impedance transformation network 116 for converting the unbalanced impedance configuration of coaxial cable 114 to the balanced impedance configuration of the transmission line 110. Each first transmission line 110 is terminated in its characteristic impedance by a resistor 118. Since second transmission line 120 is also balanced, a balun 122 may be used to couple it to a coaxial cable 124 which is in turn coupled to television receiver 10. Each second pair of conductors 120 may be left unterminated or terminated at one or both ends as shown in FIGS. 4 and 5.

The configuration shown in FIG. 3 is somewhat more practical than that shown in FIG. 2 since, due to the shielding of coaxial cables 114 and 124, it offers less possibility of radiation and susceptibility to unwanted signals due to pickup. Theoretically, the long, continuous tranmission line of the arrangement of FIG. 2 should not radiate and should not be susceptible to unwanted signals produced due to pickup because of its balanced configuration. However, the balanced configuration long transmission line 110 of the arrangement shown in FIG. 2 may be upset, e.g., due to the unequal locations of the conductors of transmission line 110 relative to metal objects, over the relatively long distances in a factory environment tending to make it more susceptible to pickup and radiation than a coaxial cable.

Figure 4:
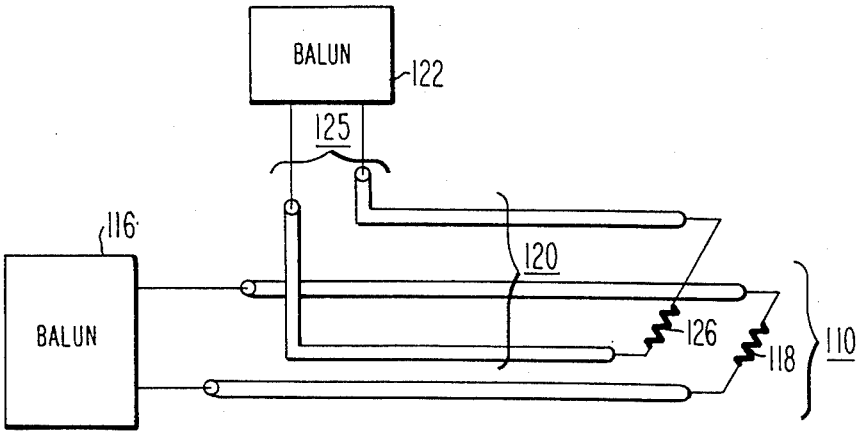
FIGS. 4 and 5 show, in detail, respective embodiments of the non-contacting signal coupling elements themselves, constructed according to further aspects of the invention, which may be employed in the arrangements shown in FIGS. 2 and 3.
Figure 5:
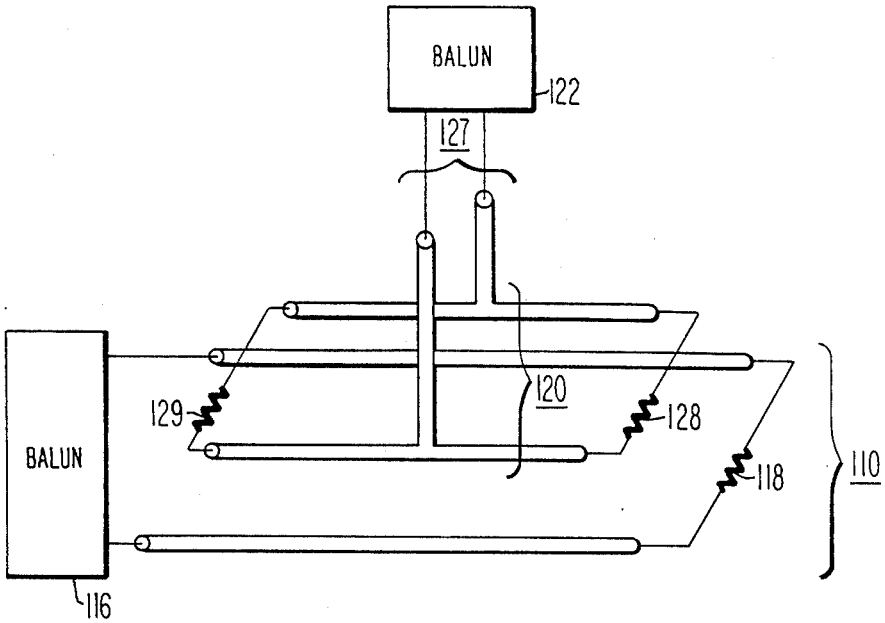

FIGS. 4 and 5 show details of respective embodiments of capacitive coupling element 100 which may be used in the arrangement of FIG. 3. It will be appreciated that a similar configuration to the one shown in connection with transmission line 120 in FIGS. 4 and 5 may also be used in connection with transmission line 120 of the arrangement of FIG. 2.

Transmission line 120 of FIG. 4 has an "L" configuration in which a third pair of conductors forming a third balanced transmission line 125 are connected between one end of respective conductors of second transmission line 120 and balun 122. As shown, the plane of the conductors of third transmission line 125 is approximately at ninety degrees with respect to the plane of the conductors of second transmission line 120. Transmission line 125 is angularly positioned approximately at ninety degrees with respect to transmission line 120 to inhibit the pickup of RF signals from transmission line 110 by transmission line 125 in an uncontrolled and unpredictable manner. Since such pickup is only possible within a short distance from transmission line 120, transmission line 125 need not be very long. While transmission line 125 is shown as being constructed in the same manner as transmission line 120, it may in practice simple comprise conventional television "twin-line" antenna wire. In the embodiment of FIG. 4, second transmission line 120 can be terminated by in its characteristic impedance by a resistor 126 or left unterminated. It has been experimentally found that the terminated configuration provides a relatively uniform coupling factor (i.e., the ratio of the amplitude of the signal provided by transmission line 120 to the amplitude of the signal received by transmission line 110) over a slightly larger bandwidth than the unterminated configuration.

Capacitive coupling element 100 of FIG. 5 has an upside down "T" configuration in which signal take-off, third transmission line 127, corresponding to signal take-off, third transmission line 125 of FIG. 4, is connected approximately at the midpoint of transmission line 120. Transmission line 120 may be terminated with its characteristic impedance at one or both ends, as is indicated by the connection of resistors 128 and 129, or left unterminated. In this case, it has been found experimentally that the unterminated configuration provides a relatively uniform coupling factor over a slighly larger bandwidth than the terminated configuration.

The conductors of transmission lines 110 and 120 may be supported in a variety of ways. For example, they may be supported in grooves of a plastic block or comprise conductors of a printed circuit board. In the former case, it has been found desirable to remove the plastic material between the conductors so that the desired characteristic impedance can be obtained without having to space the conductors of the transmission line too far apart.

The length of the conductors of second transmission line 120 is selected to pass the signals in the entire frequency range of interest without the formation of traps sometimes called signal "suckouts". For example, for RF signals in the frequency range covering VHF and UHF in the United States, i.e., from 54 MHz to 900 MHz, it was found that the length of the conductors of second transmission line 120 should be about 3 inches (7.6 centimeters). Although the length of the conductors of first transmission line 110 is not critical, it has been found that the conductors of one of first and second transmission lines 110 and 120 should be longer than the conductors of the other so that there is sufficient overlap of transmission line 110 and 120 at the workstations without requiring severe accuracy in stopping pallate 20 at a particular location. It was found that a length of about 4 inches (10.2 centimeters) for the conductors of transmission line 110 worked well. By way of example, the following table lists values of other parameters of transmission lines 110 and 120 for either of the configurations of FIGS. 4 and 5 when used with an air dielectric.

| parameter | value |
|---|---|
| conductor diameter | 0.08 inches (0.2 cm) |
| conductor separation | 0.5 inches (1.27 cm) |
| characteristic impedance | 300 ohms |
| vertical spacing between transmission lines | 0.03 inches (0.076 cm) |

With the values indicated, it was experimentally found that the coupling factor between 900 and 300 MHz was in the order of −12db (decibels). From 300 MHz to 50 MHz, the coupling factor gradually rolled-off from −12db to −25db.

In FIGS. 2, 3, 4 and 5, non-contacting coupling element 100 comprises two balanced transmission lines 110 and 120. To ensure a minimum of pickup and radiation, as explained above, it has been found desirable to couple the RF signals to and from balanced transmission lines 110 and 120 through coaxial cables. The use of coaxial cables with balanced transmission lines 110 and 120 requires the use of impedance transformation baluns as is shown in FIGS. 3, 4 and 5. To reduce cost and signal loss, it is desirable to eliminate the need for baluns. Transmission lines 210 and 220 shown in FIGS. 6*a* and 6*b* and transmission lines 310 and 320 shown in FIG. 7, which may be used in place of balanced transmission lines 110 and 120, respectively, shown in FIGS. 4 and 5, are unbalanced transmission lines and therefore do not require balun impedance transformation networks for connection to a coaxial cable. Since receiving transmission lines 220 and 320 shown in FIGS. 6*a* and FIG. 7 are similar to sending transmission lines 210 and 310, respectively, only sending transmission lines 210 and 310 will be described in detail.

FIG. 6*a* is a view of unbalanced transmission lines 210 and 220 and FIG. 6*b* is a top or plan view of unbalanced transmission line 210. Transmission line 210 is coaxial in nature and comprises a conductive metal body 211 in which a cavity 213 has been formed. A conductor 215 is located within cavity 213 substantially midway between its longitudinal walls and is connected between the center conductors of conventional "F" type coaxial connectors 217 and 219. Coaxial connector 217 is intended for connection with the coaxial cable connected to the RF signal source. Coaxial connector 219 is connected to a conventional coaxial termination element 218 with an impedance 218*a* having an impedance value substantially equal to the characteristic impedance of transmission line 210. The longitudinal sides and bottom of body 211 correspond to the outer conductor of coaxial transmission line 210 and conductor 215 corresponds to its inner conductor. Conductor 215 is bent upward toward the top of cavity 213 to increase the coupling between transmission line 210 and transmission line 220. Desirably, conductor 215 is just below, e.g., 0.005 inches (0.012 cm) to 0.010 inches (0.0254 cm) below, the top surface of body 211. The dimensions of cavity 215 and the diameter of conductor 215 are selected to have substantially the same characteristic impedance of the mating coaxial cable, e.g., 75 ohms. Similar to the case of the balanced transmission lines shown in FIGS. 2, 3, 4 and 5, it was found desirable to make the length of the center conductor of one of the transmission lines longer than the other. In this regard, typical dimension for the length of the cavities and center conductors of the sending and receiver transmission lines are 5 inches (12.7 cm) and 4 inches (10.16 cm) and 4 inches (10.16 cm) and 3 inches (7.6 cm), respectively. Typical other dimensions for transmission line 210 are indicated in the following table.

| parameter | value |
|---|---|
| width of cavity | 0.5 inches (1.27 cm) |
| depth of cavity | 0.5 inches (1.27 cm) |
| diameter of conductor | 0.08 inches (0.2 cm) |
| vertical spacing between center conductors of transmission lines | 0.03 inches (0.076 cm) |

With these values, it was experimentally found that the coupling factor between 900 and 300 MHz was in the order of −8db. From 300 to 50 MHz, the coupling factor gradually rolled-off from −8db to −25db.

FIG. 7 shows transmission lines 310 and 320 in end view. Since transmission lines 310 and 320 are similar to transmission lines 210 and 220 shown in FIGS. 6*a* and 6*b* as is indicated by correspondingly identified conductive metal body 211 and cavity 213, side and top view are not provided. Transmission line 310 also includes an "F" type coaxial connector 217 for providing the received RF signal and another "F" type coaxial connector (not shown) to which a termination element (not shown) is connected. Transmission line 310 differs from transmission line 210 of FIGS. 6*a* and 6*b* in that conductor 315 is a printed circuit conductor supported on a dielectric board 315*a* of the printed circuit board. Dielectric board 315*a* is positioned in the vertical direction by shoulders 311*a* and 311*b* at the longitudinal edges of cavity 213. Desirably, dielectric board 315*a* is positioned so that conductor 315 is just below, e.g., about 0.01 inches (0.0254 cm) below, the top surface of body 211. Shoulders 311*a* and 311*b* more accurately establish and maintain the height of the center conductor of the transmission line, and, thereby, the vertical distance between the center conductors of the two transmission lines of the non-contact coupling element, in comparison to the arrangement shown in FIGS. 6*a* and 6*b*, in which the accuracy of the vertical spacing between the center conductors depends on the accuracy of positioning the unsupported conductors 215. When the configuration shown in FIG. 7 was used, it was found that the two transmission lines could be brought closer together. It was experimentally found that unbalanced transmission lines configured as shown in FIG. 7 with the center conductors spaced apart by 0.02 inches (0.051 cm) using 0.0625 inch (0.16 cm) wide printed circuit board center conductors and with the same other dimensions indicated above for the configuration shown in FIGS. 6*a* and 6*b* provided a coupling factor between 900 and 300 MHz that rolled-off gradually from −4db to −9db and between 300 and 50 MHz that rolled-off to −20db.

The system for moving pallate 20 described with reference to FIG. 1 is exemplary but is advantageous in that the combination of wheels 22 and rails 30 provides a convenient mechanism for guiding first transmission line 110 into both the proper vertical and lateral positions with respect to second transmission line 120. However, other pallate conveyor systems, e.g., such as a conveyor belt with guides at each work station for vertically and laterally positioning pallate 20 may be used. With respect to the embodiments of FIGS. 6*a* and 6*b* and of FIG. 7, it is noted that the opposite surfaces of the bodies of transmission lines 210 and 220 and transmission lines 310 and 320, respectively, may make contact and thereby serve as guides for establishing the vertical distance between the center conductors of the transmission lines. While the contact may slightly improve the coupling factor, it is not relied on for providing sufficient signal coupling and therefore this type of arrangement operates in the same manner and has the same benefits of the other non-contacting signal coupling arrangements according to the invention shown in FIGS. 2, 3, 4, 5, 6*a* and 6*b* and 7. These and other modifications are intended to be within the scope of the invention defined by the following claims.

I claim:

1. Apparatus for coupling a high frequency signal from a signal source to a unit under test at at least one workstation, comprising:

a first pair of substantially parallel conductors forming a first balanced transmission line located at said workstation;

first coupling means for coupling said high frequency signal from said signal source to between said conductors of said first transmission lines; said first coupling means including a coaxial cable coupled to said signal source and a balun coupled between said coaxial cable and said first transmission line;

a second pair of substantially parallel conductors forming a second balanced transmission line;

second coupling means for coupling said second pair of conductors to said unit under test; and moving means for moving said second transmission line with respect to said first transmission line to position each conductor of said second pair of conductors into an overlying but non-contacting relationship with a respective conductor of said first pair of conductors so that said high frequency signal from said signal source is capacitively coupled from each conductor of said first pair of conductors of said first transmission line to a respective conductor of said second pair of conductors of said second transmission line to develop a test signal for said unit under test between said conductors of said second transmission line when said unit under test is moved to said workstation.

2. The apparatus recited in claim 1 wherein:

said first transmission line has a first end to which said signal source is directly coupled by said first coupling means and a second end to which a first terminating element is coupled.

3. The apparatus recited in claim 2 wherein:

said first terminating element is a resistive element having a value substantially equal to the value of the characteristic impedance of said first transmission line.

4. The apparatus recited in claim 3 wherein:

said second transmission line has a first end to which said unit under test is directly coupled by said second coupling means and a second end to which a second terminating element is coupled.

5. The apparatus recited in claim 4 wherein:

said second terminating element is a resistive element having a value substantially equal to the characteristic impedance of said second transmission line.

6. The apparatus recited in claim 1 wherein:

said second coupling means includes a balun coupled to said second transmission line and a coaxial cable coupled between said balun and said unit under test.

7. The apparatus recited in claim 1 wherein:

said second coupling means includes a third pair of conductors having a third transmission line connected to respective connection points along respective ones of said conductors of said second transmission line.

8. The apparatus recited in claim 7 wherein:

said connection points are substantially midway along respective ones of said conductors of said second transmission line.

9. The apparatus recited in claim 7 wherein:

said connection points are substantially at the ends of respective ones of said conductors of said second transmission line.

10. The apparatus recited in claim 1 wherein:

said conductors of one of said first and second transmission lines are longer than said conductors of the other one of said first and second transmission lines.

11. The apparatus recited in claim 10 wherein:

said conductors of said first transmission line are longer than said conductors of said second transmission lines.

12. The apparatus recited in claim 11 wherein:

said conductors of said second transmission line are approximately three inches (or 7.6 centimeters) long.

13. The apparatus recited in claim 12 wherein:

said conductors of said first transmission line are approximately four inches (or 10.2 centimeters) long.

14. Apparatus for coupling a high frequency signal from a signal source to a unit under test at at least one workstation, comprising:

a first pair of conductors; one conductor of said first pair of conductors of said first transmission line partially surrounding the other one conductor of said first pair of conductors in a coaxial configuration to form a first unbalanced transmission line; said one conductor of said pair of conductors of said first transmission line comprising a body having a cavity with a generally rectangular opening defining longitudinal walls and said other one conductor of said first pair of conductors being axially located substantially midway between said longitudinal walls of said cavity;

first coupling means for coupling said high frequency signal from said signal source to between said conductors of said first transmission lines;

a second pair of conductors; one conductor of said second pair of conductors of said second transmission line partially surrounding the other one conductor of said second pair of conductors in a coaxial configuration to form a second unbalanced transmission line; said one conductor of said second pair of conductors of said second transmission line comprising a body having a cavity with a generally rectangular opening defining longitudinal walls and said other one conductor of said pair of conductors being axially located substantially midway between said longitudinal walls of said cavity;

second coupling means for coupling said second pair of conductors to said unit under test; and moving means for moving said second transmission line with respect to said first transmission line to position each conductor of said second pair of conductors into an overlying but non-contacting relationship with a respective conductor of said first pair of conductors so that said high frequency signal from said signal source is capacitively coupled from each conductor of said first pair of conductors of said first transmission line to a respective conductor of said second pair of conductors of said second transmission line to develop a test signal for said unit under test between said conductors of said second transmission line when said unit under test is moved to said workstation.

15. The apparatus recited in claim 14 wherein:

said first coupling means includes a first coaxial connector connected to said first transmission line, said connector having an outer conductor connected to said body of said first transmission line and an inner conductor connected to said other one of said pair of conductors of said first transmission line; and said second coupling means includes a second coaxial connector connected to said second transmission line, said connector having an outer conductor connected to said body of said second transmission line and an inner conductor connected to said other one of said pair of conductors of said second transmission line.

16. The apparatus recited in claim 15 wherein:

said other one of said pair of conductors of said first transmission line is a conductors of a printed circuit board mounted at said opening of said cavity of said first transmission line; and said other one of said pair of conductors of said second transmission line is a conductors of a printed circuit board mounted at said opening of said cavity of said second transmission line.

* * * * *